US006250882B1

(12) United States Patent
Nagashima

(10) Patent No.: US 6,250,882 B1
(45) Date of Patent: Jun. 26, 2001

(54) PORTABLE WORKING MACHINE PROVIDED WITH A CENTRIFUGAL AIR BLOWER

(75) Inventor: Akira Nagashima, Kanagawa (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 09/401,341

(22) Filed: Sep. 21, 1999

(30) Foreign Application Priority Data

Sep. 25, 1998 (JP) ..... 10-271568

(51) Int. Cl.[7] ..... F04D 29/44

(52) U.S. Cl. ..... 415/204; 415/123; 415/200; 415/148; 415/915

(58) Field of Search ..... 415/123, 200, 415/203, 204, 206, 148, 915; 15/328, 330, 339, 405; 222/346; 134/93; 68/78 R

(56) References Cited

U.S. PATENT DOCUMENTS 4,120,616 * 10/1978 Dwyer et al. ..... 415/206
4,392,614 * 7/1983 Groth et al. ..... 239/215
4,809,502 * 3/1989 Iida et al. ..... 60/216
5,383,427 * 1/1995 Tuggle et al. ..... 123/51 BA
5,975,862 * 11/1999 Arahata et al. ..... 417/234
6,004,093 * 12/1999 Ishikawa ..... 415/98

FOREIGN PATENT DOCUMENTS 519549 5/1993 (JP) .
67802 3/1994 (JP) .

* cited by examiner

*Primary Examiner*—Edward K. Look
*Assistant Examiner*—Richard Woo
(74) *Attorney, Agent, or Firm*—Baker Botts L.L.P.

(57) ABSTRACT

A portable working machine provided with a centrifugal air blower, which is featured in that a prime mover (50) for driving the air blower (20) is mounted via a supporting coupling member (30) on a volute case (22) of the air blower (20) which is mounted in an upright state; and that an air inlet port of the air blower (20) is positioned on the side of the volute case (22) which is closer to the prime mover (50).

15 Claims, 6 Drawing Sheets

PORTABLE WORKING MACHINE PROVIDED WITH A CENTRIFUGAL AIR BLOWER

BACKGROUND OF THE INVENTION

This invention relates to a portable working machine provided with a centrifugal air blower which is designed to be driven by means of a prime mover such as an air-cooled two-stroke internal combustion engine. More specifically, this invention relates for example to a shoulder type chemicals spraying machine for performing a spraying work of chemicals, or to a shoulder type air-blowing cleaner for collecting scattered objects such as fallen leaves and dusts by making use of air to be ejected from an air blower.

The conventional portable working machine of this kind such as a shoulder type chemicals spraying machine for instance is constructed generally as seen in Japanese Utility Model Publication H5-19549. Namely, it comprises a centrifugal air blower which is mounted in an upright state on a shouldering frame having an L-shaped configuration as viewed laterally and attached with a shouldering strap, and a prime mover such as an air-cooled two-stroke internal combustion engine which is mounted on the rear side of the air blower (on the rear portion of the shouldering frame) for driving the air blower.

Further, a separate chemicals storage tank is connected via a flow rate adjusting device to an upper portion of a volute case of the air blower. The chemical in the chemicals storage tank is made to be sucked into the volute case through the flow rate adjusting device, and then, while being carried by the flowing air, ejected from an air-ejecting nozzle which is projected downward diagonally from one side (usually right side) of the volute case, the ejected chemicals being ultimately ejected into the outside atmosphere after passing through a bent pipe, a bellows type flexible pipe and a blowing pipe.

However, the aforementioned conventional portable working machine provided with a centrifugal air blower is accompanied with the following problems.

Namely, since the air inlet port of the air blower is generally formed on a back of the shouldering frame, a relatively large air intake gap for introducing air from the outside atmosphere is inevitably formed between the shouldering frame and the air blower (the volute case of the air blower). As a result, the heavy weight portions such as the air blower, the chemicals storage tank and the prime mover are displaced rearward from the back of the shouldering frame by a distance corresponding to the air intake gap. In this case, as the center of gravity of the heavy weight portions such as the air blower, the chemicals storage tank and the prime mover is located further away from the back of the shouldering frame, the working machine constituted by these heavy weight portions is more likely to be moved away from the back of the shouldering frame, so that it becomes more difficult to easily carry the working machine on an operator's back, thus deteriorating the operability and portability of the working machine.

In the case of the conventional working machine, the shouldering frame, the volute case, the chemicals storage tank, the flow rate adjusting device, etc. are generally individually manufactured in advance, and subsequently, integrally assembled. Therefore, the conventional working machine is accompanied with the problems that it requires a large number of parts, it is heavy and bulky as a whole, it is difficult to assemble, and that the manufacturing cost of the working machine is relatively high.

BRIEF SUMMARY OF THE INVENTION

This invention has been made to cope with the aforementioned problems, and therefore an object of the present invention is to provide a portable working machine provided with a centrifugal air blower, which is capable of improving the workability and portability thereof, of minimizing the number of parts and the manufacturing cost thereof, of reducing the size and weight thereof, and of simplifying the assembling work thereof.

With a view to realize the aforementioned object, this invention provides a portable working machine provided with a centrifugal air blower, which is featured in that a prime mover for rotating said air blower is mounted via a supporting coupling member on a volute case of said centrifugal air blower which is mounted in an upright state; and that an air inlet port of said air blower is positioned on the side of said volute case which is closer to said prime mover.

In a preferable embodiment of this invention, an air-intake port for introducing the outside air into the air inlet port of said air blower is formed on a portion of said supporting coupling member which is located between said air blower and said prime mover.

More preferably, a chemicals storage tank is mounted over said volute case. More preferably, said volute case and said chemicals storage tank are integrally formed by means of a blow molding for instance.

In another preferable embodiment of this invention, a rear surface portion of said volute case which is located away from said prime mover is functioned as a back of the shouldering frame. In a further preferable embodiment of this invention, a back-pad is attached to the rear surface portion of said volute case. In a still preferable embodiment of this invention, a rotational shaft of an impeller of said air blower is axially supported by a bearing portion attached to said supporting coupling member.

In another preferable embodiment of this invention, a rotational shaft of said impeller is drivingly connected via a centrifugal clutch with an output shaft of said prime mover.

In a still preferable embodiment of this invention, a flow rate adjusting device is interposed between said volute case and said chemicals storage tank, and a stand is formed underneath the bottom surface of said supporting coupling member.

According to the portable working machine provided with a centrifugal air blower of this invention which is constructed as mentioned above, since the air inlet port of the air blower is positioned on the side close to a prime mover, and at the same time, the outside air is introduced from the air-intake port which is formed in the supporting coupling member, the rear surface portion which is located away from the internal combustion engine of the air blower can be functioned as a back of the shouldering frame.

Therefore, the conventional back of the shouldering frame that has been required to be employed as the air inlet port of the air blower is disposed on the back of the shouldering frame side is no more required to be employed, and at the same time, the air intake gap is no more required to be formed between the back of the shouldering frame and the volute case of the air blower. As a result, the center of gravity of the heavy weight portions such as the air blower, the chemicals storage tank and the internal combustion engine can be placed closer to the operator's back as compared with the case of the conventional chemicals spray machine.

Accordingly, it becomes possible not to allow the working machine as a whole to be easily departed from the operator's back, thereby making it possible for the operator to easily carry the working machine on his/her back, thus improving the workability and the portability of the working machine.

Further, since the volute case, the chemicals storage tank, etc. can be integrally molded by means of a blow molding method for instance, it becomes possible to minimize the number of parts and manufacturing cost of the devices, to reduce the size and weight of the air blower, and to simplify the assembling thereof.

DETAILED DESCRIPTION OF THE INVENTION

Various embodiments of the portable working machine according to this invention will be explained in details below with reference to the drawings.

Figure 1:
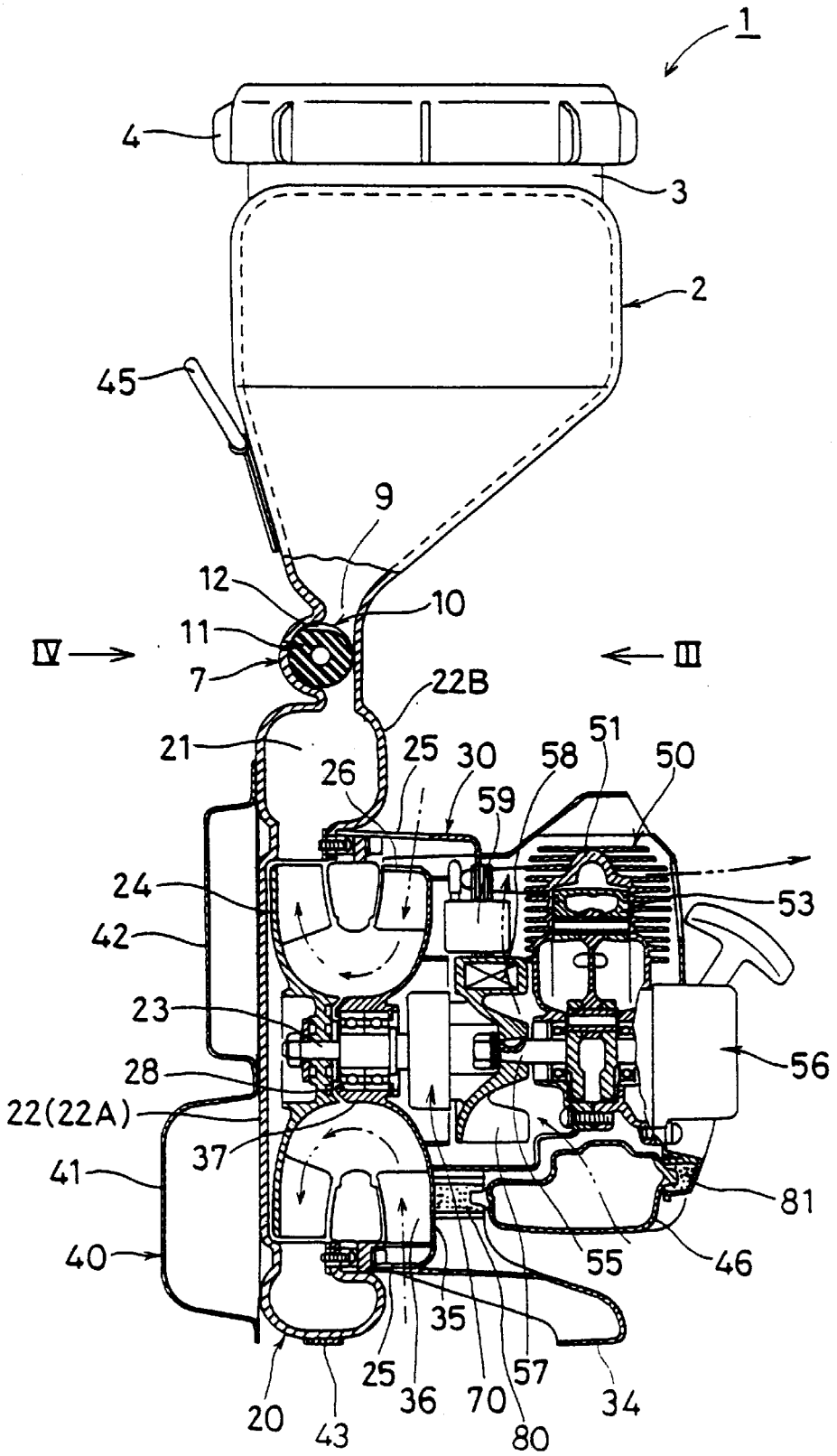
FIG. 1 is a partially sectioned longitudinal left side view of one embodiment of a shoulder type chemicals spraying machine representing one example of the portable working machine provided with a centrifugal air blower according to this invention.

FIG. 1 illustrates one embodiment of a shoulder type chemicals spraying machine representing one example of the portable working machine provided with a centrifugal air blower according to this invention. The shoulder type chemicals spraying machine 1 according this embodiment is provided with a centrifugal air blower 20 which is mounted in an upright state and constituted by a volute case 22 and an impeller 24. The volute case 22 of the air blower 20 is consisted of a rear surface portion 22A and a front surface portion 22B, both being shaped to constitute a volute chamber 21. An air-cooled two-stroke internal combustion engine 50 to be functioned as a prime mover for driving the air blower 20 is securely attached via a supporting coupling member 30 to the front surface portion 22B of the volute case 22.

A chemicals storage tank 2 for storing a chemical in the form of a granular substance is formed at an upper portion of the volute case 22. This chemicals storage tank 2 is of a funnel-like configuration where a lower outlet port 9 side is contracted and the upper portion thereof is provided with a chemical inlet port 3 which is designed to be closed with a cap 4.

A pair of cushion pads 43 are attached to the right and left bottom portions of the volute case 22, respectively.

A flow rate adjusting device 10, which would be discussed hereinafter, is interposed between the chemicals storage tank 2 and the volute case 22. This flow rate adjusting device 10 is provided with a passage portion 7 communicating with the outlet port 9 of the chemicals storage tank 2. The cross-section of the passage portion 7 is formed of a slit wherein the width thereof in the direction of right and left (in the direction of right and left in FIGS. 3 and 4) is elongated while the width thereof in the direction of front and rear (in the direction of right and left in FIGS. 1 and 2) is shortened. In this embodiment, the chemicals storage tank 2, the volute case 22 and the passage portion 7 of the flow rate adjusting device 10 are all formed of a synthetic resin and integrally molded by means of a blow molding method for instance.

Figure 2:
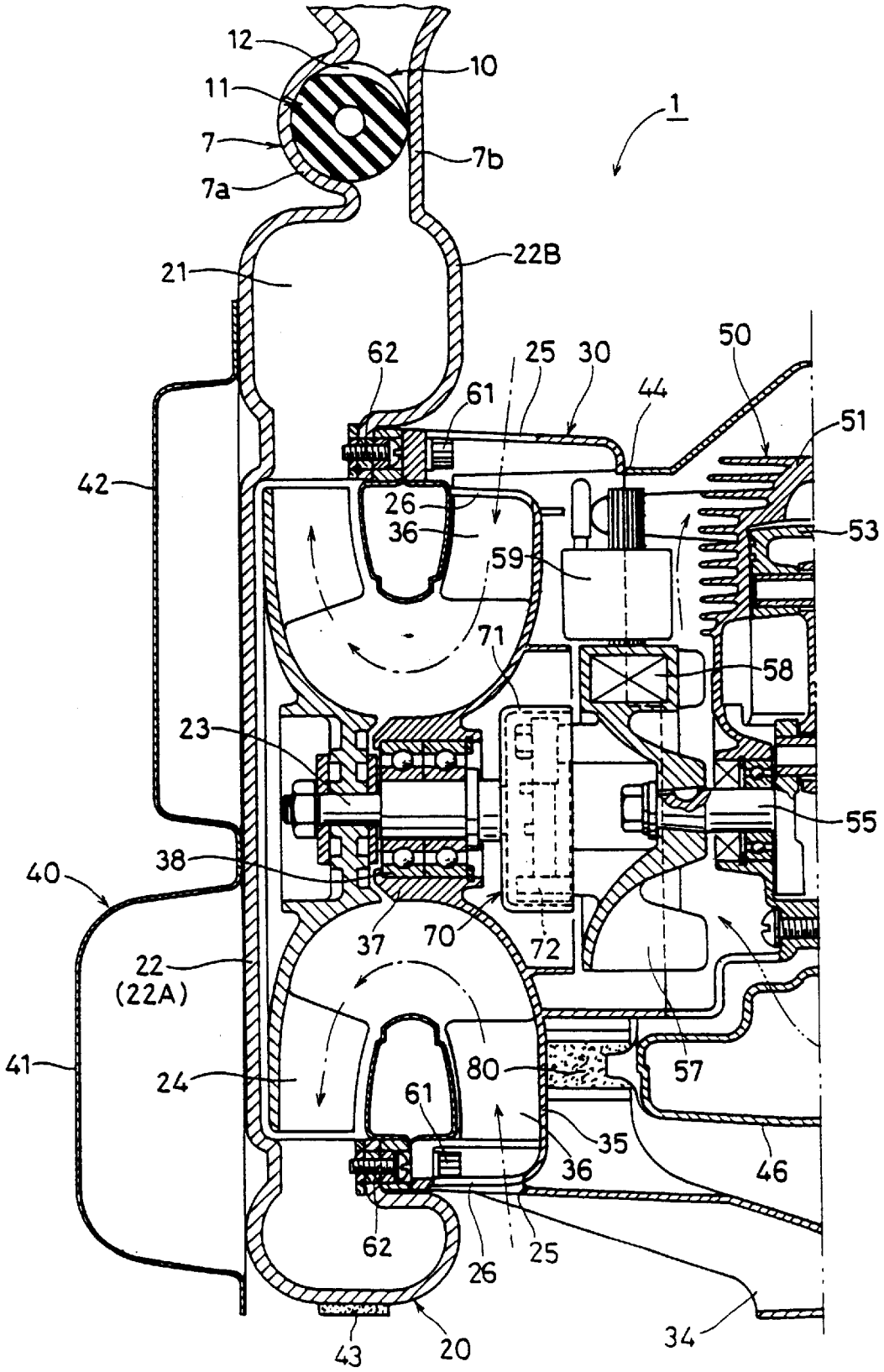
FIG. 2 is an enlarged longitudinal sectional view illustrating the air-blower and the peripheral portion of the internal combustion engine shown in FIG. 1.

The internal combustion engine 50 may be an air-cooled two-stroke internal combustion engine having a displacement of 35 mL or so which is suited for use in a bush cutter for instance. The cylinder 51 in which a piston 53 is fittingly inserted is provided in the well known manner with an exhaust port and scavenging ports. The crank shaft 55 of the engine 50 is provided at one end portion thereof (the right side in FIG. 1) with a recoil starter 56, and at the other end portion thereof with a cooling fan/fly wheel 57 having a magnet 58 implanted therein. Thus, this cooling fan/fly wheel 57 is designed to be revolved integral with the crank shaft 55. Further, an ignition coil 59 is disposed at the upper portion of the engine 50 so as to face the magnet 58. By the way, arrows indicated by two-dot chain lines in FIGS. 1 and 2 illustrate the flow of engine cooling air. A fuel tank 46 is disposed below the internal combustion engine 50 and secured to the engine 50 through a pair of cushion rubbers 80 and 81.

As clearly shown in FIG. 2, the cooling fan/fly wheel 57 is connected with clutch shoes 72 of a centrifugal clutch 70, while a clutch drum 71 of the centrifugal clutch 70 is connected integrally with a rotation shaft 23 of the impeller 24 of the air blower 20. In other words, the crank shaft 55 of the internal combustion engine 50 is drivingly connected with the rotation shaft 23 of the impeller 24 through the centrifugal clutch 70.

On the other hand, the supporting coupling member 30 is formed of a short cylindrical configuration and mounted coaxial with the crank shaft 55. The outer peripheral portion of the supporting coupling member 30 which is located close to the air blower 20 is secured by means of bolts 61 and nuts 62 to the front surface portion 22B of the volute case 22. A stand 34 is integrally formed underneath the bottom of the outer peripheral portion of the supporting coupling member 30. Further, a flange (not shown) is projected around a fixing face 44 between the supporting coupling member 30 and the internal combustion engine 50, thereby detachably connecting them with each other. On the air blower 20 side of the supporting coupling member 30, there is disposed an inner periphery supporting portion 35 which is provided with a bearing portion 37 for axially supporting the rotational shaft 23 of the impeller 24. Air inlet ports 26 of the air blower 20 are formed on the outer periphery of the inner periphery supporting portion 35, or in the vicinity of the internal combustion engine 50 as it is viewed from the volute case 22. At the same time, a predetermined number of outside air guiding plates 36 are attached, at predetermined intervals, to the outer periphery of the inner periphery supporting portion 35.

Further, air-intake ports 25 for introducing the outside air into the air inlet ports 26 of the air blower 20 are formed on the outer periphery of the supporting coupling member 30, i.e. on a portion between the air blower 20 and the internal combustion engine 50. Accordingly, when the impeller 24 is caused to rotate by means of the internal combustion engine 50, the outside air is caused, as shown by arrows indicated by dotted lines in FIGS. 1 and 2, to be sucked into the volute chamber 21 defined by the volute case 22, after passing through the air-intake ports 25 and the air inlet ports 26. The air sucked in this manner is then compressed and accelerated in the volute chamber 21 before it is ejected therefrom toward the outer atmosphere through the ejection nozzle 29 which is directed obliquely downward and rightward (FIG. 3).

The rear surface portion 22A of the volute case 22, which is located away from the internal combustion engine 50 in the air blower 20, is designed to function as a back of the shouldering frame, thus enabling shouldering straps (not shown) to be attached to the rear surface portion 22A.

A hollow back-pad 40 formed of a cushioning synthetic resin is integrally attached to the rear surface portion 22A by making use of an adhesive for instance. This back-pad 40 is consisted of a lower half portion 41 which is relatively prominently projected from the rear surface portion 22A so as to be contacted with the waist of an operator, and an upper half portion 42 where a plurality of vertical grooves 42*a* are intermittently formed so as to be contacted with the back of the operator (FIG. 4).

Figure 3:
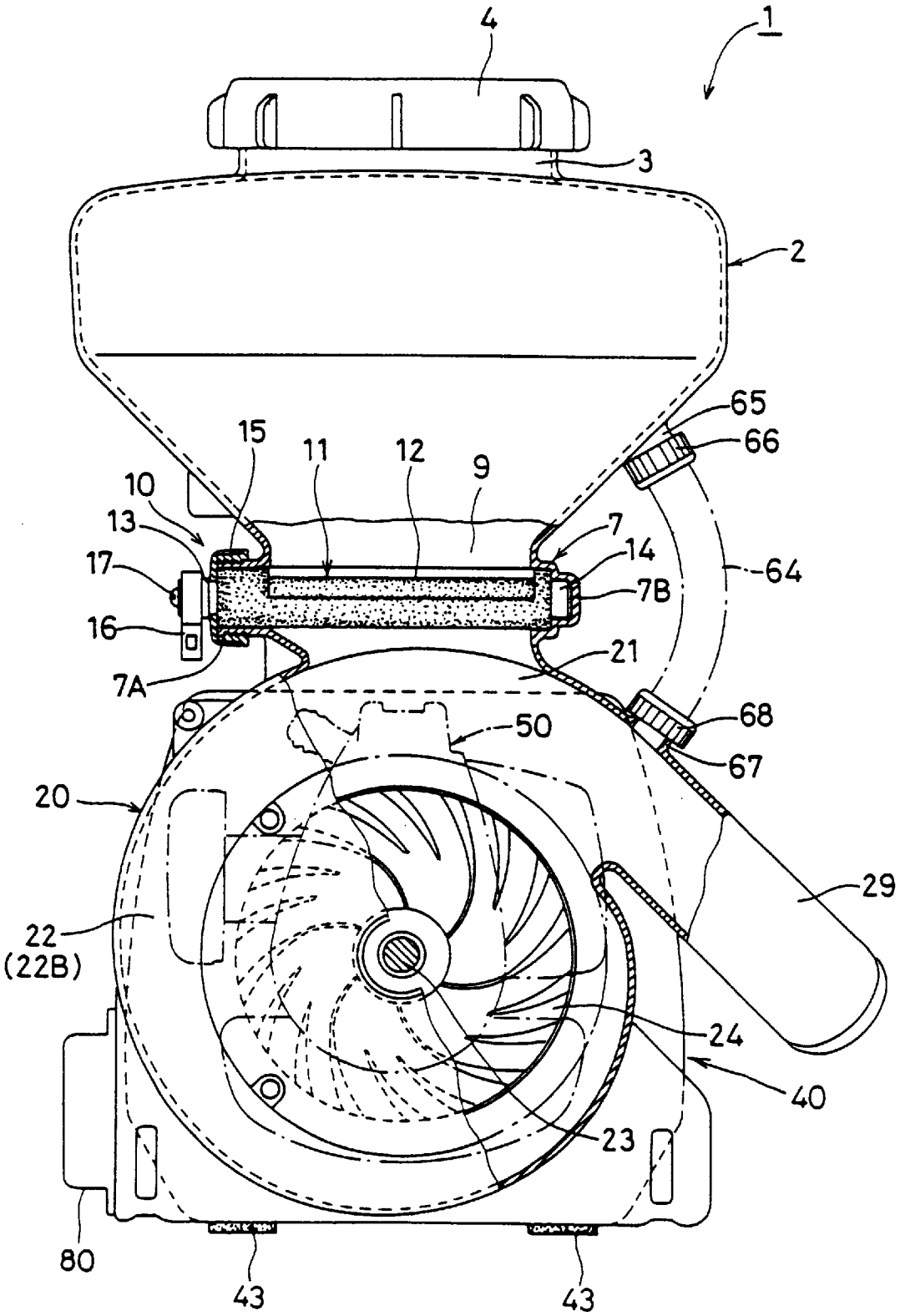
FIG. 3 is a partially sectioned front view as it is viewed as indicated by the arrow III in FIG. 1.
Figure 4:
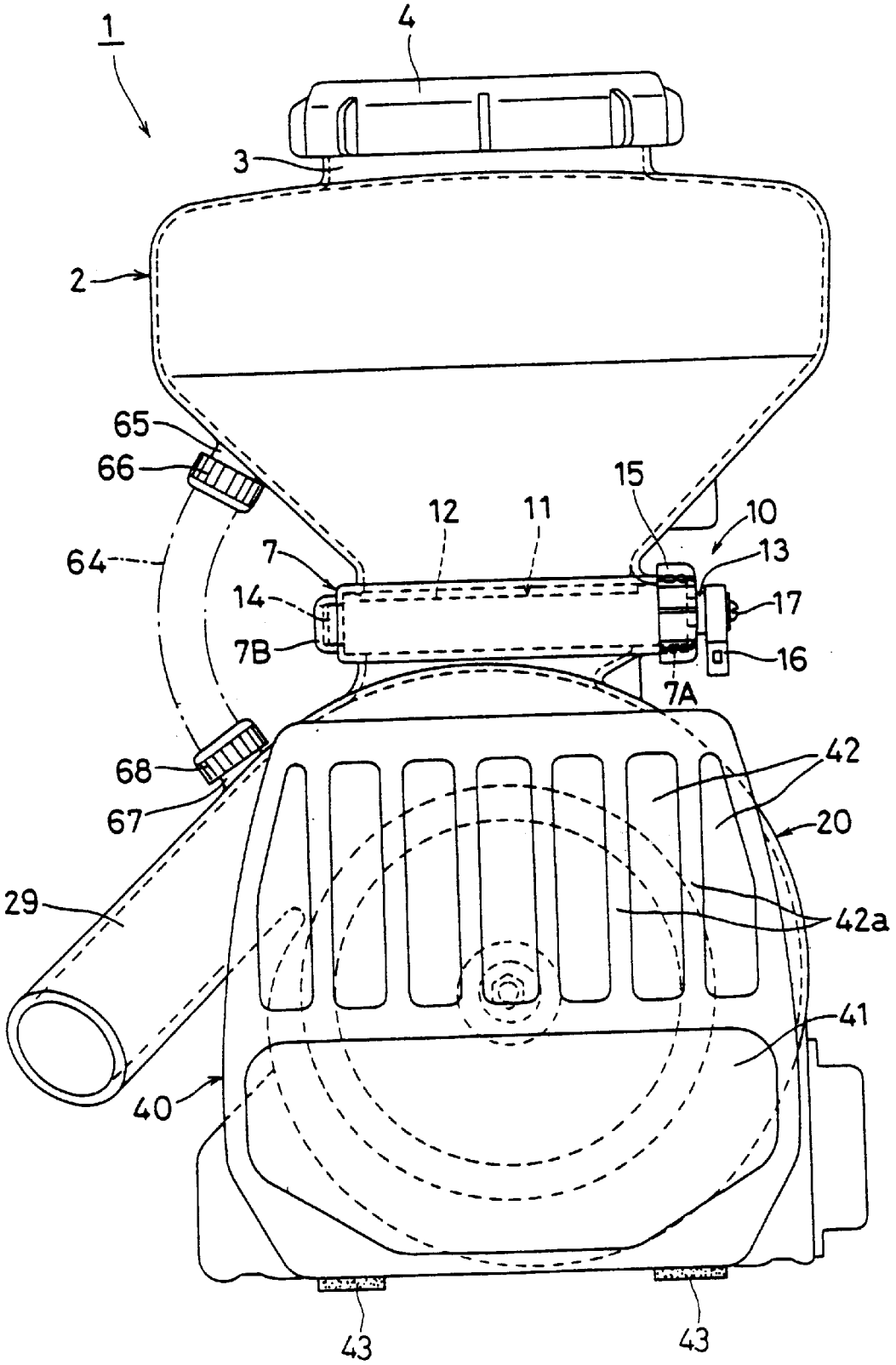
FIG. 4 is a rear elevational view as it is viewed as indicated by the arrow IV in FIG. 1.
Figure 5:
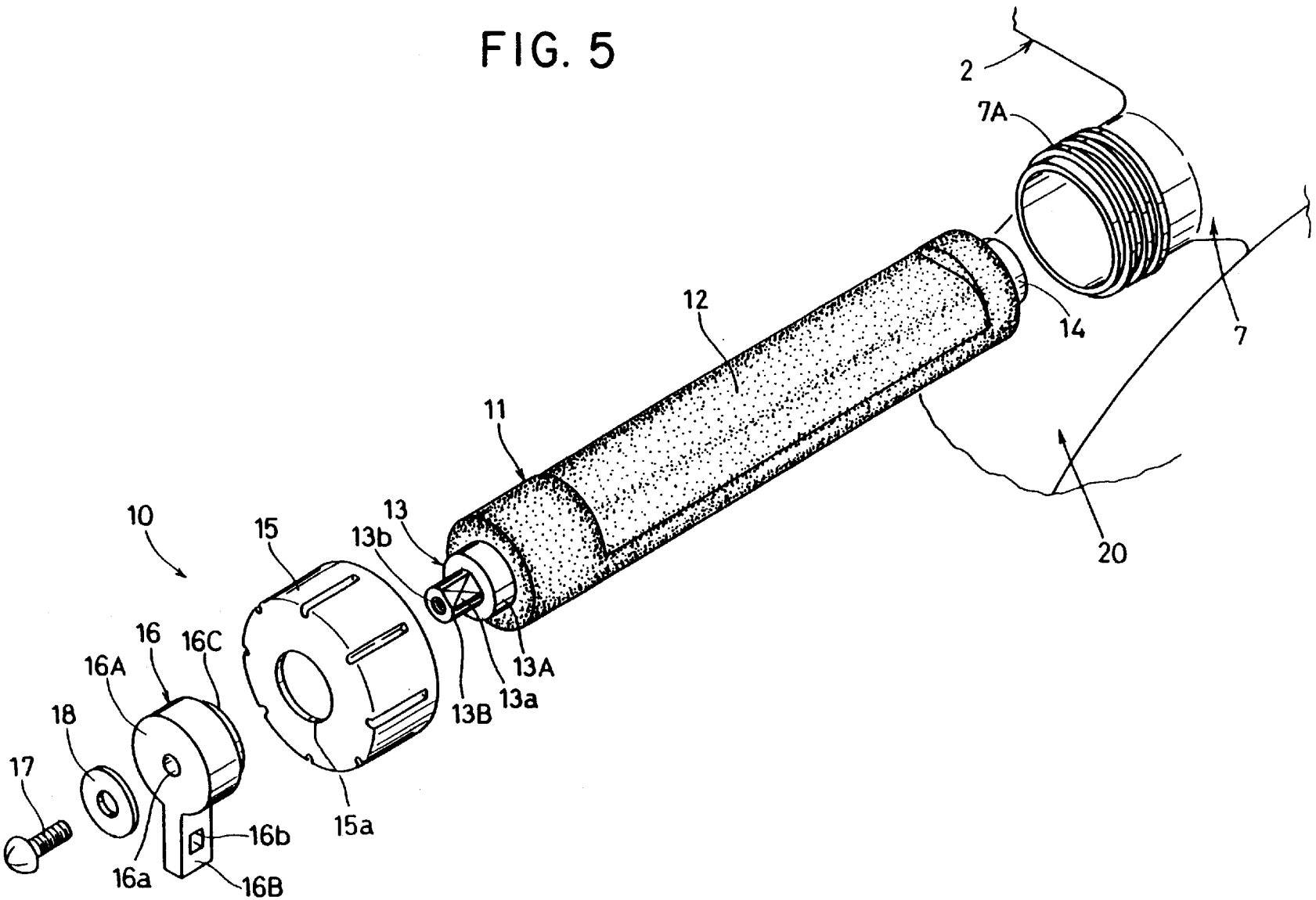
FIG. 5 is an exploded perspective view showing a flow rate adjusting device which is designed to be attached to the chemicals spraying machine shown in FIG. 1.

As clearly shown in FIGS. 3, 4 and 5, the flow rate adjusting device 10 is provided with a rotatable shutter 11 formed of an elastic substance such as rubber or a foamed synthetic resin, which is inserted into the passage portion 7 where a chemical as a feeding substance is allowed to flow downward from the chemicals storage tank 2. More specifically, the rotatable shutter 11 is rendered to traverse the width of the passage portion 7 in the direction of right and left (in the direction of right and left in FIG. 3) and press-contacted with the inner wall of the passage portion 7 so as to close the passage portion 7. Thus, the flow rate of a chemical flowing downward through the passage portion 7 can be adjusted according to the rotational angle of the rotatable shutter 11.

Namely, both end portions of the rotatable shutter 11 are respectively formed of a cylindrical body having an outer diameter which is almost equal to or slightly larger than the width of the passage portion 7 in the longitudinal direction thereof (in the direction of right and left in FIGS. 1 and 2). The intermediate portion of the rotatable shutter 11 is partially recessed in the radial direction thereof to thereby form a cut-out portion 12 having a length which is approximately equal to the width, in the direction of right and left, of the passage portion 7. Namely, the rotatable shutter 11 is formed of a partially cut cylindrical body. As seen from the cross-sectional view shown in FIG. 2, this cut-out portion 12 is configured such that the depth as measured from the outer circumferential surface thereof is gradually increased along the outer circumference thereof.

Further, as shown in FIG. 2, one inner side of the passage portion 7 (the rear surface portion 22A of the volute case 22) is curved into a semi-circular arch thereby allowing approximately a half of the outer circumferential surface of the rotatable shutter 11 to be closely contacted therewith, while the other inner side of the passage portion 7 (the front surface portion 22B of the volute case 22) is constituted by a flat surface.

One end portion (the right side portion in FIG. 3) of the rotatable shutter 11 is fixedly provided with a supporting shaft 14 which is rotatably fitted in a bearing portion 7B having a stepped and bottomed cylindrical configuration and being projected from the passage portion 7. The other end portion (the left side portion in FIG. 3) of the rotatable shutter 11 is fixedly provided with a stepped supporting shaft 13 to be fitted in the bearing hole 15*a* of a cap 15 which is adapted to be screwed on an externally threaded cylindrical mounting port 7A which projects from the passage portion 7.

This stepped supporting shaft 13 is consisted of an inserting portion 13A to be inserted into the bearing hole 15*a* of the cap 15, and a rotatable shaft portion 13B having a non-circular cross-section provided with a chamfered portion 13*a*. This rotatable shaft portion 13B is designed to be inserted into a lever member 16. This lever member 16 is consisted of a cylindrical base body 16A which is to be positioned on the outer side of the cap 15, a lever portion 16B extending in the radial direction from the cylindrical base body 16A, and a fitting portion 16C provided with a fitting hole (not shown) into which the rotatable shaft portion 13B can be lockedly inserted.

This lever member 16 is rotatably coupled with the left side supporting shaft 13 by making use of a locking screw 17 which is designed to be screwed via a washer 18 into an internally threaded portion 13*b* formed in the rotatable shaft portion 13B. This lever member 16 is designed to be rotated by the operation of an operating lever (not shown) disposed in an operating member-attaching box 80 (FIG. 3) which is disposed below (diagonally leftward) the volute case 22, the rotation of this lever member 16 being effected through a Bowden cable, a link mechanism or a gear mechanism. As this lever member 16 is rotated, the rotatable shutter 11 is also caused to rotate.

The rotatable shutter 11 is designed to be inserted via the mounting port 7A into the passage portion 7 in such a manner that the right side supporting shaft 14 is directed as a leading head and laterally traverses the passage portion 7 in the right and left direction thereof. At the same time, this rotatable shutter 11 is detachably mounted inside the passage portion 7 by means of the cap 15 which is disposed on the left supporting shaft 13 side.

According to the aforementioned flow rate adjusting device 10, the rotatable shutter 11 at the time of non-operation (at the time when the spray operation is not to be performed) takes a posture wherein the cut-out portion 12 is positioned at the upper side, while the other portion other than this cut-out portion 12 is caused to elastically contact with the inner walls of the passage portion 7 thereby completely closing the passage portion 7 (i.e. a closed state), thus-preventing the chemical in the chemicals storage tank 2 from flowing downward due to the effect of the rotatable shutter 11.

Figure 6A:
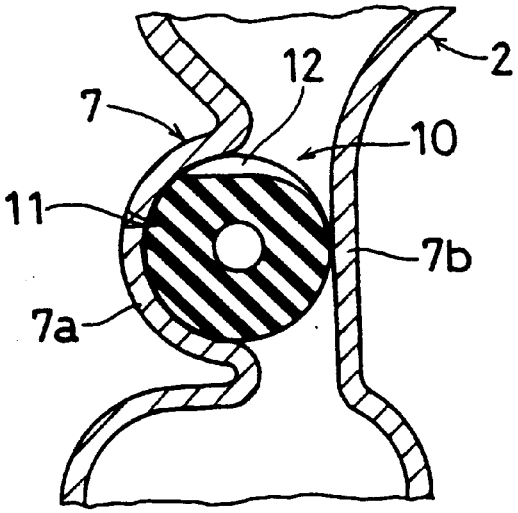
FIGS. 6A and 6B show respectively a cross-sectional view illustrating the operation of the flow rate adjusting device shown in FIG. 5.
Figure 6B:
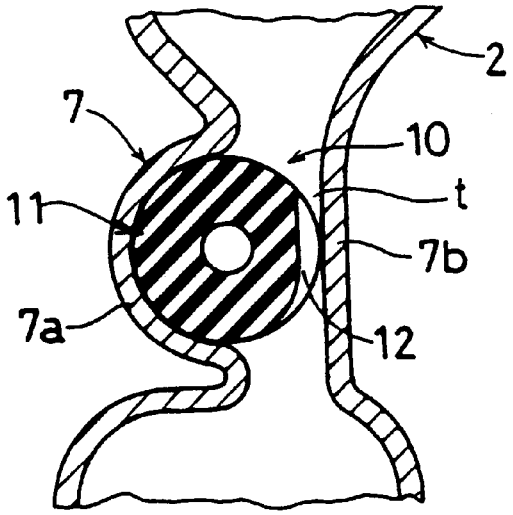

On the other hand, at the time of operation (at the time when the spray operation is to be performed), the lever member 16 is rotated so as to cause the rotatable shutter 11 to rotate clockwise from the closed state shown in FIG. 6(A). As a result, a gap t corresponding to the depth of the cut-out portion 12 is caused to generate between the cut-out portion 12 and the inner wall of the passage portion 7, thus allowing the chemical in the chemicals storage tank 2 to flow downward through this gap t. In this case, since this cut-out portion 12 is configured such that the depth as measured from the outer circumferential surface thereof is gradually increased along the outer circumference thereof, the degree of the flow rate of the chemical increases as the rotation angle of the rotatable shutter 11 is increased. Therefore, when the rotatable shutter 11 is rotated to such an extent that makes the gap t maximum as shown in FIG. 6(B), the flow rate of the chemical becomes maximum.

The chemical from the chemicals storage tank 2 that has passed through the rotatable shutter 11 of the flow rate adjusting device 10 is sucked into the volute case 22, and then, while being carried by air flowing in the volute case 22, ejected from the air-ejecting nozzle 29 (FIGS. 3 and 4) which is projected downward diagonally from one side of the volute case 22, the ejected chemical being ultimately ejected into the outside atmosphere after passing through a bent pipe, a bellows type flexible pipe and a blowing pipe (all not shown).

According to the shoulder type chemicals spray machine 1 of this embodiment which is constructed as explained above, since the air inlet ports 26 of the air blower 20 is positioned on the side close to the internal combustion engine 50, and at the same time, the outside air is introduced from the air-intake ports 25 which are formed in the supporting coupling member 30, the rear surface portion 22A which is located away from the internal combustion engine 50 in the air blower 20 can be functioned as the back of the shouldering frame.

Therefore, the conventional back of the shouldering frame that has been required to be employed as the air inlet port of the air blower is disposed on the back of the shouldering frame side is no more required to be employed, and at the same time, the air intake gap is no more required to be formed between the back of the shouldering frame and the volute case of the air blower. As a result, the center of gravity of the heavy weight portions such as the air blower 20, the chemicals storage tank 2 and the internal combustion engine 50 can be placed closer to the operator's back as compared with the case of the conventional chemicals spray machine.

Accordingly, it becomes possible not to allow the shoulder type chemicals spray machine 1 as a whole to be easily departed from the operator's back, thereby making it possible for the operator to carry the spray machine 1 on his/her back, thus improving the workability and the portability of the spray machine 1.

Further, since the volute case 22, the chemicals storage tank 2 and the passage portion 7 of the flow rate adjusting device 10 can be all formed of a synthetic resin and integrally molded by means of a blow molding method for instance, it becomes possible to minimize the number of parts and manufacturing cost of the devices, to reduce the size and weight of the air blower, and to simplify the assembling thereof.

Additionally, since the rotation shaft 23 of the impeller 24 is drivingly connected with the crank shaft 55 of the internal combustion engine 50 through the centrifugal clutch 70, the internal combustion engine 50 can be started by means of the recoil starter 56 without accompanying the rotation of the impeller 24 which imposes relatively a large load on the engine 50, thus making it possible to facilitate the start-up.

As clearly seen from FIGS. 3 and 4, according to this embodiment, pipe-like connecting ports 65 and 67 each having an external thread are provided at the chemicals storage tank 2 as well as in the vicinity of the ejection nozzle 29 of the air blower 20. A flexible tube 64 may be connected between these connecting ports 65 and 67 as required, thus making it possible to introduce a portion of air flow from the blower 20 into the chemicals storage tank 2 and pressurize the interior of the chemicals storage tank 2 so as to prevent the chemical from clogging at the outlet port 9 or in the vicinity of the rotatable shutter 11. If there is no need to introduce air into the interior of the chemicals storage tank 2, these connecting ports 65 and 67 can be closed by making use of caps 66 and 68, respectively.

In the foregoing explanation, this invention has been explained with reference to one embodiment. However, this invention should not be construed to be limited by this embodiment, but may be variously modified within the spirit of this invention claimed in the appended claims.

For example, although a shoulder type chemicals spraying machine has been explained in the above embodiment as one example of a portable working machine provided with a centrifugal air blower, this invention is not limited to such an embodiment, but can be applied to other kinds of shoulder type air-blowing cleaning machine which is not provided with a chemicals storage tank.

As for the prime mover, it is not limited to an air-cooled two-stroke internal combustion engine but may be an electric motor.

As would be clearly understood from the aforementioned explanations, according to the portable working machine provided with a centrifugal air blower of this invention, since the air inlet port of the air blower is positioned on the side close to a prime mover, and at the same time, the outside air is introduced from the air-intake port which is formed in the supporting coupling member, the rear surface portion which is located away from the internal combustion engine in the air blower can be functioned as a back of a shouldering frame.

Therefore, the conventional back of the shouldering frame that has been required to be employed as the air inlet port of the air blower is disposed on the back of the shouldering frame side is no more required to be employed, and at the same time, the air intake gap is no more required to be formed between the back of the shouldering frame and the volute case of the air blower. As a result, the center of gravity of the heavy weight portions such as the air blower, the chemicals storage tank and the internal combustion engine can be placed closer to the operator's back as compared with the case of the conventional chemicals spray machine.

Accordingly, it becomes possible not to allow the working machine as a whole to be easily departed from the operator's back, thereby making it possible for the operator to easily carry the working machine on his/her back, thus improving the workability and the portability of the working machine.

Further, since the volute case, the chemicals storage tank, etc. can be integrally molded by means of a blow molding method for instance, it becomes possible to minimize the number of parts and manufacturing cost of the devices, to reduce the size and weight of the air blower, and to simplify the assembling thereof.

Additionally, since the prime mover is designed to be mounted on the volute case via a supporting coupling member, this same prime mover can be employed for other purposes.

What is claimed is:

1. A portable working machine, comprising a centrifugal air blower having a volute case, a prime mover for driving the air blower, and a supporting coupling member mounting the volute case of the air blower in an upright position on the prime mover, an air inlet port of the air blower being positioned on the side of the volute case which is closer to the prime mover and an air-intake port for introducing outside air into the air inlet port of the air blower being formed on a portion of the supporting coupling member which is located between the air blower and the prime mover.

2. The portable working machine according to claim 1, wherein a chemicals storage tank is provided over the volute case.

3. The portable working machine according to claim 2, wherein the volute case and the chemicals storage tank are integrally formed.

4. The portable working machine according to claim 2, wherein the volute case and the chemicals storage tank are integrally formed by means of blow molding.

5. The portable working machine according to claim 2, wherein a flow rate adjusting device is interposed between the volute case and the chemicals storage tank.

6. The portable working machine provided according to claim 1, wherein a rear surface portion of the volute case which is located away from the prime mover is adapted to serve as a shouldering frame by which the portable working machine can be carried on the back of a person operating the working machine.

7. The portable working machine according to claim 6, wherein a back-pad is attached to the rear surface portion of the volute case.

8. The portable working machine according to claim 1, wherein a rotational shaft of an impeller of the air blower is axially supported by a bearing portion provided in the supporting coupling member.

9. The portable working machine according to claim 1, wherein a rotational shaft of the impeller is drivingly connected by a centrifugal clutch with an output shaft of the prime mover.

10. The portable working machine according to claim 1, wherein a stand is mounted underneath a bottom surface of the supporting coupling member.

11. A portable working machine, comprising a centrifugal air blower having a volute case, a prime mover for driving the air blower, a supporting coupling member mounting the volute case of the air blower in an upright position on the prime mover, an air inlet port of the air blower being positioned on a side of the volute case which is closer to the prime mover, and a chemicals storage tank being provided over the volute case, the volute case and the chemicals storage tank being integrally formed.

12. The portable working machine according to claim 11, wherein the volute case and the chemicals storage tank are integrally formed by means of blow molding.

13. The portable working machine according to claim 11, wherein a flow rate adjusting device is interposed between the volute case and the chemicals storage tank.

14. A portable working machine, comprising a centrifugal air blower having a volute case, a prime mover for driving the air blower, and a supporting coupling member mounting the volute case of the air blower in an upright position on the prime mover, an air inlet port of the air blower being positioned on the side of the volute case which is closer to the prime mover, and a rear surface portion of the volute case which is located away from the prime mover being adapted to serve as a shouldering frame by which the portable working machine may be carried on the back of a person operating the working machine.

15. The portable working machine according to claim 14, wherein a back-pad is attached to the rear surface portion of the volute case.

* * * * *